US008019260B2

(12) United States Patent
Endo et al.

(10) Patent No.: US 8,019,260 B2
(45) Date of Patent: Sep. 13, 2011

(54) IMAGE FORMING APPARATUS

(75) Inventors: Rie Endo, Kanagawa-ken (JP); Shuji Moriya, Shizuoka-ken (JP); Katsuhiro Sakaizawa, Numazu (JP); Norio Takahashi, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/765,344

(22) Filed: Apr. 22, 2010

(65) Prior Publication Data

US 2010/0202806 A1 Aug. 12, 2010

Related U.S. Application Data

(62) Division of application No. 11/589,144, filed on Oct. 30, 2006.

(30) Foreign Application Priority Data

Nov. 1, 2005 (JP) ..... 2005/318549
Oct. 27, 2006 (JP) ..... 2006/292711

(51) Int. Cl.
*G03G 15/08* (2006.01)

(52) U.S. Cl. ..... 399/285; 399/279

(58) Field of Classification Search ..... 399/236, 399/252, 279, 281, 285, 286
See application file for complete search history.

(56) References Cited

U.S. PATENT DOCUMENTS 5,948,582 A 9/1999 Nakamura et al.
6,549,742 B1 4/2003 Chigono et al.
6,871,035 B2 3/2005 Nakagawa
7,366,434 B2 * 4/2008 Ream et al. ..... 399/55
2005/0058922 A1 3/2005 Magome et al.

FOREIGN PATENT DOCUMENTS

CN 1203384 A 12/1998
CN 1460902 A 12/2003
CN 1595304 A 3/2005
JP 7-325475 A 12/1995
JP 2003-122047 A 4/2003

OTHER PUBLICATIONS

Notification of Second Office Action dated Jul. 12, 2010, in counterpart Chinese Application No. 200810128087.5.
Chinese Notification of the First Office Action dated Nov. 6, 2009 in Chinese Application No. 2008101280875 and English translation thereof.
Notification of the First Office Action dated Mar. 21, 2008, in counterpart Chinese Application No. 200610143135.9.

* cited by examiner

*Primary Examiner* — David M Gray
*Assistant Examiner* — Gregory H Curran
(74) *Attorney, Agent, or Firm* — Fitzpatrick, Cella, Harper & Scinto

(57) ABSTRACT

An image forming apparatus includes an image bearing member; a developer carrying member, contactable to the image bearing member, for carrying a developer to a developing position to develop an electrostatic image formed on the image bearing member with the developer; a supplying member for supplying the developer to the developer carrying member, wherein a peripheral speed of the developer carrying member is not less than 1.05 times and not more than 1.20 times a peripheral speed of the image bearing member, and an arithmetic average roughness Ra is not less than 0.20 times and not more than 0.33 times a volume average particle size of the developer, wherein a potential applied to the supplying member is different from a potential applied to the developer carrying member toward a larger potential of a regular charge polarity of the developer.

3 Claims, 8 Drawing Sheets

IMAGE FORMING APPARATUS

This application is a divisional of U.S. patent application Ser. No. 11/589,144, filed Oct. 30, 2006.

FIELD OF THE INVENTION AND RELATED ART

The present invention relates to an image forming apparatus using an electrophotographic type or electrostatic recording type process, such as a laser beam printer, a copying machine or a facsimile machine.

Conventionally, for example, in an image forming apparatus using the electrophotographic type process, a surface of an electrophotographic photosensitive member (photosensitive member) (image bearing member) is charged by a charging means, and thereafter, the surface of the photosensitive member is exposed with light modulated in accordance with image information, so that electrostatic image (latent image) is formed on the surface of the photosensitive member. The electrostatic image is developed with toner of a developer supplied from a developing device into a toner image. The toner image is transferred from the photosensitive member onto a transfer material (printing sheet, OHP sheet, textile or the like), and then, the toner image is fixed by fixing means.

As a developing method for developing the toner image, a one component developing system using a one component developer, for example, has been put into practice. In the one component developing system, a rotatable developer carrying member for feeding the developer to the photosensitive member is rotated with a proper relative speed difference relative to the photosensitive member and is press-contacted or contacted to the photosensitive member in an image forming apparatus, for example.

The developer used here is a one component developer substantially consisting of resin material toner particle (toner) only. The developer may contain externally added material (auxiliary particle) to adjust the flowability and to stabilize the toner chargeability. The toner particle per se may contain wax. The wax is intended to prevent glare of the recording material (transfer material) such as the recording paper by the fixing oil used during the toner image being fixed on the transfer material and to improve separation of the transfer material from the fixing device. The developing method using the non-magnetic one component developer is advantageous in that no magnetic material is necessary in the developer, and therefore, the apparatus can be simplified and downsized. In addition, the developing method using the non-magnetic one component developer is advantageous in the suitability to the full-color image forming apparatus because of the good coloring nature, for example.

Referring first to FIG. 8, there is shown a conventional developing device.

In FIG. 8, the developer carrying member is a developing roller 21 having an elasticity and an electroconductivity. The developer carrying member is press-contacted or contacted to the image bearing member during the developing operation, and therefore, there is a liability that image bearing member is damaged if the developer carrying member is a rigid member. For this reason, the developing roller 21 is made of an elastic member. An electroconductive layer may be provided on the surface of the developing roller 21 or in the neighborhood of the surface thereof and may be supplied with a developing bias voltage.

A developer regulating member in the form of a regulating blade 22 is contacted to the developing roller in order to form a uniform thin toner layer and in order to apply electric charge to the toner. In this case, the regulating blade 22 in the form of an elastic metal or rubber blade having an elasticity is supported on a blade supporting metal plate, and a neighborhood of the free end thereof is contacted to the outer surface of the developing roller. When the regulating blade 22 is not disposed at an opening of a developing container, it is disposed downstream of the elastic roller 23 in the developing container.

In the developing container, the elastic roller 23 is contacted to the developing roller and is rotated. The elastic roller 23 is a sponge roller which functions to supply the toner to the developing roller 21 and to remove the remaining toner from the developing roller 21.

With the developing device having the above-described structure, a thin layer of the non-magnetic toner can be satisfactorily formed on the developing roller 21, and therefore, the electrostatic latent image on the photosensitive drum 24 can be developed satisfactorily. The developing roller 21 is driven at a higher peripheral speed than the photosensitive drum 24 in order to provide an image substantially free from fog with a sufficient image density. In order to provide a high density image substantially free from fog, Japanese Laid-open Patent Application Hei 11-221219, for example, discloses a regulation of the peripheral speed ratio between the photosensitive drum 24 and the developing roller 21.

However, when the developer carrying member is driven at the higher speed than the image bearing member for the purpose of providing the high density image substantially free from the fog, the toner on the developer carrying member is subjected to a rubbing force in the contact nip in the contact developing system. Therefore, when the apparatus is continuously operated, the toner is deteriorated due to the rubbing force and/or heat applied in the contact nip between the developer carrying member and the image bearing member. The deterioration of the toner means embedded in g of the externally added material (deposited on the outer periphery of the toner) into the toner and/or liberation of the externally added material from the toner. As a result of the deterioration, the charge amount per unit weight of the toner decreases, and/or the agglomerativeness of the toner particles increases, resulting in image defects such as production of ghost image and the like.

SUMMARY OF THE INVENTION

Accordingly, it is a principal object of the present invention to provide an image forming apparatus with which an image defects due to the deterioration of the developer is suppressed, and therefore, long term usability is accomplished.

It is another object of the present invention to provide an image forming apparatus in which a damage which may be caused to the developer by the rubbing of the developer in the contact region between the developer carrying member and the image bearing member while maintaining the sharp and clear image with sufficient image density and substantially free from production of the foggy background.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

Hereinafter, the image forming apparatus in accordance with the present invention will be described in more detail with reference to the appended drawings.

Figure 1:
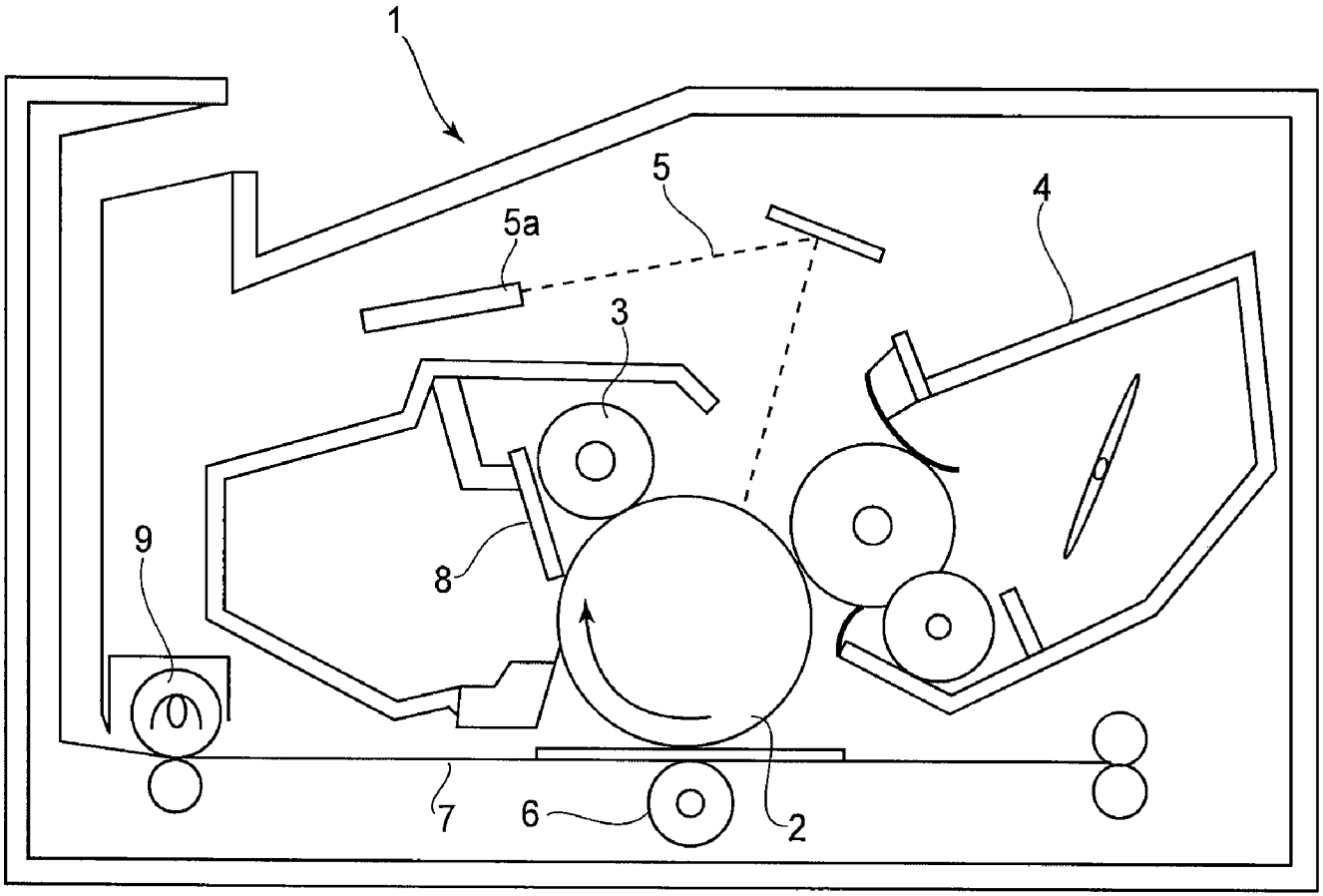
FIG. 1 is a schematic illustration of an image forming apparatus according to an embodiment of the present invention.
Figure 2:
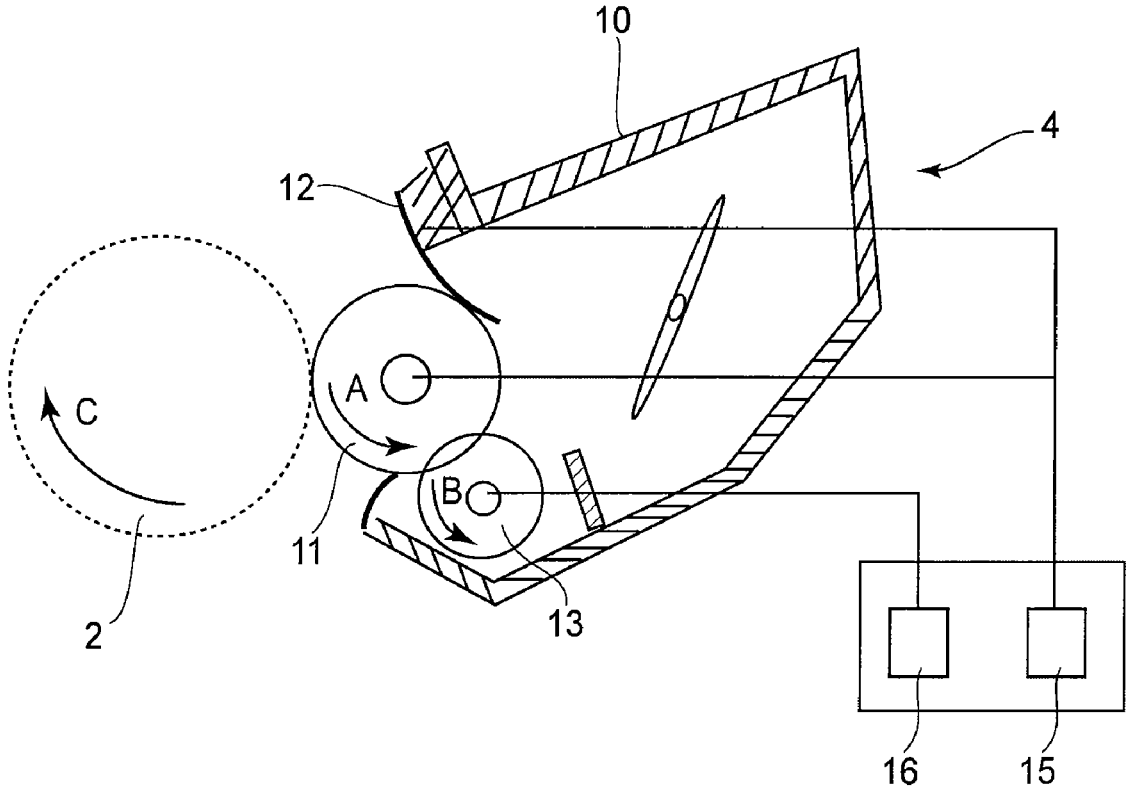
FIG. 2 is a schematic illustration of a developing device according to an embodiment of the present invention.

FIG. 1 is a schematic sectional view of the image forming apparatus in accordance with the present invention, and FIG. 2 is a schematic sectional view of the developing apparatus employed by the image forming apparatus.

First, referring to FIG. 1, the general structure and operation of the image forming apparatus 1 structured in accordance with the present invention will be described.

The image forming apparatus 1 in this embodiment is a laser beam printer which forms an image on a sheet of transfer medium (recording paper, OHP sheet, fabric, etc.) with the use of an electrophotographic image forming method, and outputs the sheet of transfer medium. More specifically, it forms an image on the recording medium, in response to picture information signals from a picture information source, such as a personal computer, an original reading apparatus, or the like, which is connected to the main assembly of the image forming apparatus 1 (which hereafter may be referred to as apparatus main assembly) so that information can be transmitted between the picture information source and the image forming apparatus 1. The image forming apparatus 1 in this embodiment is provided with a developing apparatus which uses nonmagnetic single-component developer.

Referring to FIG. 1, an electrophotographic photosensitive member 2 (which hereafter will be referred to as photosensitive drum 2) rotates in the direction indicated by an arrow mark in the drawing. As the photosensitive drum 2 is rotated, the peripheral surface of the photosensitive drum 2 is charged by a charge roller 3, which is a charging means, to preset polarity (which in this embodiment is negative) and potential level. Thereafter, the charged peripheral surface is exposed to the beam of laser light 5 from a laser-based optical apparatus 5*a*, which is an exposing means. As a result, an electrostatic latent image is formed on the peripheral surface of the photosensitive drum 2. The developer bearing member is pressed upon the peripheral surface of the photosensitive drum 2 so that the developer bearing member apparently enters the photosensitive drum 2 by a preset amount. The electrostatic latent image is developed into a visible image formed of the developer (toner). Hereafter, this visible image will be referred to as toner image.

The toner image, which is the visualized latent image, on the photosensitive drum 2 is transferred by a transfer roller 7, onto recording medium as the transfer medium. The transfer residual toner, that is, the toner remaining on the photosensitive drum 2 without being transferred, is scraped away by a cleaning blade 8, that is, a cleaning member, which constitutes a cleaning means. After being scraped away from the photosensitive drum 2, the transfer residual toner is stored in a waste toner bin. After being cleaned, the photosensitive drum 2 is used for the formation of the next image; the photosensitive drum 2 is repeatedly used for the above described image formation process.

Meanwhile, the recording medium (transfer medium), onto which the toner image has just been transferred, is heated by a fixing apparatus 9. As a result, the toner image is welded (fixed) to the recording medium. After the fixation, the recording medium is discharged from the apparatus main assembly.

Next, referring to FIG. 2, the developing apparatus, with which the above described image forming apparatus is provided, will be described.

Referring to FIG. 2, a developing apparatus 4 has a developing means container 10, in which developer, more specifically, nonmagnetic single-component toner, is stored. The normal polarity to which the toner is chargeable is negative. The developing means container 10 has an opening which extends in the lengthwise direction of the developing means container 10. The developing apparatus 4 is provided with a development roller 11, which constitutes a developer bearing member. The development roller 11 is disposed in the developing means container 10 so that it opposes the photosensitive drum 2 through the abovementioned opening to develop the electrostatic latent image on the photosensitive drum 2 into a visible image.

As the developer, nonmagnetic single-component developer is used. One of the internal additives of the developer (toner) is wax (toner particles contain wax), which is added for the following reason: It has been a common practice to use fixation oil to facilitate the separation of the transfer medium from the fixing apparatus 9. However, fixation oil tends to make glary the recording medium (transfer medium), such as recording paper, when toner is fixed to the recording medium. Thus, wax is added to the list of the internal toner additives, in order to facilitate the separation of the transfer medium from the fixing apparatus 9, without using fixation oil. Further, in order to improve toner in transfer efficiency to form an image of higher quality, silica, which is an external additive for improving toner in fluidity, is added to toner. That is, the surface of a toner particle is coated with a film of the external additive to improve the toner particle in the ability to be negatively charged, and also, to create microscopic gaps among toner particles to improve the toner in fluidity. As the external toner additive usable with the toner used in this embodiment, there are metallic oxides (aluminum oxide, titanium oxide, strontium titanate, cerium oxide, magnesium oxide, chromium oxide, tin oxide, zinc oxide, etc.), nitride (silicon nitride, etc.), and carbide (silicon carbide, etc.), etc. In addition, metallic salt (calcium sulfate, barium sulfate, calcium carbonate, etc.), fatty acid metallic salt (zinc stearate, calcium stearate, etc.), carbon black, silica, etc., are usable. These external additives are added by 0.01-10 parts in weight, preferably 0.05-5 parts in weight, per 100 parts in weight of toner. These external additives may be individually used, or in combination. They are preferred to be rendered hydrophobic.

If the amount by which the external additive is added is no more than 0.01 part in weight, single-component developer, such as the one in this embodiment, is inferior in fluidity, being therefore lower in transfer efficiency and development efficiency. Further, an image which is nonuniform in density is formed, and/or a so-called "scatteration" occurs; toner scatters along the border between an area of an image covered with toner, and a blank area of the image. On the other hand, if the amount of the external additive in the single-component developer is no less than 10 parts in weight, the excessive amount of external additive adheres to the photosensitive drum 2 and development roller 11, making it harder for the toner to be charged, and therefore, it is likely that a nonuniform image is formed. As for the shape of a toner particle, toner is desired to be no less than 100 and no more than 160 in shape factor SF-1, which shows the sphericity of a particulate substance measurable with an image analyzing apparatus. Further, the value of the shape factor SF-2 of the toner is desired to be no less than 100 and no more than 140. As long as the shape factors SF-1 and SF-2 of a toner is within the abovementioned ranges, the particles of the toner are considered spherical and smooth across their surface. Incidentally, the shape factors SF-1 and SF-2 of the toner used in this embodiment were obtained using the following method. That is, 100 randomly picked toner particles were photographed at a magnification of 500 times with the use of an FE-SEM (S-800: product of Hitachi, Ltd.). Then, the thus obtained picture information was inputted into an image analyzing apparatus Luzcx 3 (product of Nikore Co., Ltd.) through an interface to analyze the picture information, and analyzed. The shape factors SF-1 and SF-2 are defined by the following equations:

$$SF\text{-}1=\{(MXLNG)^2/AREA\}\times(\pi/4)\times 100$$

$$SF\text{-}2=\{(PERI)^2/AREA\}\times(1/\pi 4)\times 100$$

AREA: projected area of toner particle

MXLNG: absolute maximum length

PERI: circumference

Incidentally, as for the relationship between shape factor and the actual shape, the shape factor SF-1 indicates the sphericity of a particle, and the is greater the shape factor SF-1, the further from being spherical. The shape factor SF-2 indicates the degree of unevenness of the surface of a particle, and the greater the shape factor SF-2, the more uneven the surface of the surface of the particle. Therefore, a toner particle, the surface factors SF-1 and SF-2 of which are in the abovementioned range, easily rolls, and is likely to be uniformly charged by friction. Therefore, a toner, the shape factors SF-1 and SF-2 of which are in the abovementioned range, is smaller in the amount of particles which fail to be charged, or are charged to the reverse polarity. Incidentally, the uncharged toner particles and reversely charge toner particles cause an image forming apparatus to form an image which suffers from fog. Further, a toner, the shape factors SF-1 and SF-2 are in the abovementioned range, is uniformly charged, being therefore excellent in terms of the conformity to an electric field. Therefore, it performs better as developer, and also, is superior in terms of transferability, being advantageous even from the standpoint of forming a high quality image, which requires an electrostatic latent image to be developed in microscope detail. Further, the higher level of transferability of the toner reduces the amount by which the toner is left on the photosensitive drum 2.

The development roller 11, which is elastic, is horizontally disposed at the abovementioned opening of the developing means container 10, with the right-hand half (in FIG. 2) being inside the developing means container 10 and the left-hand half being exposed from the developing means container 10. The area of the peripheral surface of the development roller 11, which is exposed from the developing means container 10, opposes the peripheral surface of the photosensitive drum 2. The photosensitive drum 2 is located on the left-hand side of the developing apparatus 4, and the development roller 11 is kept pressed upon the peripheral surface of the photosensitive drum 2 so that the former apparently invades into the latter by a preset amount. The average amount of the apparent invasion of the development roller 11 into the photosensitive drum 2, in terms of the circumferential direction of the development roller 11, is desired to be in a range of 10 μm-50 μm. "Amount of apparent invasion" means the distance between where the peripheral surface of the development roller 11 is while the development roller 11 remains pressed upon the photosensitive drum 2, and where the peripheral surface of the development roller 11 is after the photosensitive drum 2 alone is removed without displacing the rotational axis of the development roller 11. If the average amount of apparent invasion is no more than 10 μm, it is difficult for the development roller 11 to scrape away the toner having adhered to the area of the peripheral surface of the photosensitive drum 2, which correspond to the blank areas of an image, from the photosensitive drum 2. As a result, not only does the amount of the so-called fog formation toner, that is, the toner which remains adhered to the area of the peripheral surface of the photosensitive drum 2, which correspond to the blank areas of an image, increase, but also, it is impossible to reliably achieve a sufficient level of image density. On the other hand, if the amount of apparent invasion is increased beyond 50 μm, the friction between the development roller 11 and photosensitive drum 2 becomes excessive, being likely to deteriorate toner. That is, the external additive particles adhering to the surface of a toner particle are likely to be buried into the toner particle or separated from the toner particle, and also, the toner is likely to reduce in the amount by which it is charged per unit weight. Further, the toner particles are more likely to agglomerate. Therefore, it is likely that a defective image, such as an image suffering from ghosts, is formed.

The photosensitive drum 2, which constitutes an image bearing member, is a rigid member, and is made up of an aluminum cylinder as a substrate, and a photosensitive layer coated on the peripheral surface of the aluminum cylinder to a preset thickness. Before the photosensitive drum 2 is subjected to the actual image formation process, the photosensitive drum 2 is charged by the charge roller 3. The peripheral surface of the charged photosensitive drum 2 is exposed to a scanning beam of laser light projected, in an oscillatory manner, from a laser scanner as an exposing means (image writing means), while being modulated with picture information signals. As a result, an electrostatic image is formed on the peripheral surface of the photosensitive drum 2. Next, the electrostatic image formed on the photosensitive drum 2 is supplied with toner as developer, by the developing apparatus 4, turning into a visible image formed of toner (toner image); the electrostatic latent image on the photosensitive drum 2 is developed into a toner image by the developing apparatus 4 and toner.

In this embodiment, the development roller 11 is made up of a base layer formed of silicon rubber, and an acrylic-urethane rubber layer coated on the peripheral surface of the base layer to a thickness of 20 μm; it has two primary layers. Its electrical resistance is in a range of $10^3$-$10^7$ ohm. The electrical resistance of the development roller 11 was calculated from the amount of electric current which flowed between a stainless steel cylinder, which is 30 mm in external diameter, and the development roller 11, while 100 V of direct voltage was applied between the metallic core of the development roller 11 and the stainless steel cylinder, with the development roller 11 and stainless cylinder kept in contact with each other. As the material for the elastic layer, ordinary rubber, such as silicon rubber, urethane rubber, butyl rubber, epichlorohydrin rubber, nitrile-butadiene rubber, ethylene-propylene-diene rubber (EPDM), foam made of any of the preceding substances, etc., are usable. When a toner, which is negative in the normal polarity to which it is chargeable, is used, urethane resin, polyamide resin, silicone resin, etc., which are suitable for frictionally charging toner to the negative polarity, may be used as the material for the surface layer of the development roller 11. On the other hand, when a toner, which is positive in the normal polarity to which it is chargeable, is used, fluorinated resin, or the like, which is suitable for frictionally charging toner to the positive polarity, is usable as the material for the surface layer of the development roller 11. As to the hardness of the development roller 11, the development roller 11, the hardness of which measured by an Asker-C hardness gauge (product of Koobunshi Keiki Co., Ltd.), with the application of one kilogram of load, was in a range of 35°-65°, was used. It is preferable that the hardness of the development roller 11 measured by an Asker-C hardness gauge is in a range of 40°-60°.

The development roller 11 is rotationally driven in the direction indicated by an arrow mark A in FIG. 2. The peripheral velocity of the development roller 11 is set so that it is no less than 105%, and no more than 120%, relative to that of the photosensitive drum 2. The diameter of the development roller 11 was 16 mm. The rotational direction of the development roller 11 is such that the direction in which the peripheral surface of the development roller 11 moves in the contact area between the development roller 11 and photosensitive drum 2 is the same as the peripheral surface of the photosensitive drum 2 moves in the contact area. If the abovementioned peripheral velocity of the development roller 11 is no more than 105% of that of the photosensitive drum 2, there is virtually no friction between the development roller 11 and photosensitive drum 2, in the contact nip, and therefore, the toner which has transferred from the development roller 11 onto the photosensitive drum 2 and adhered to the areas of the peripheral surface of the photosensitive drum 2, which correspond to the blank portions of an image, cannot be recovered onto the development roller 11. Therefore, the fog formation toner increases. In particular, if the ratio of the peripheral velocity of the development roller 11 relative to that of the photosensitive drum 2 is 100%, that is, when there is no difference in peripheral velocity between the development roller 11 and photosensitive drum 2, there is virtually no friction between the peripheral surfaces of the development roller 11 and photosensitive drum 2. Therefore, it is likely that an extremely foggy image is formed. On the other hand, if the ratio of the peripheral velocity of the development roller 11 relative to that of the photosensitive drum 2 exceeds 120%, the friction between the development roller 11 and photosensitive drum 2 becomes excessive. Therefore, even though the fog formation toner reduces, the damage to the toner increases; the external additive adhering to the surface of a toner particle is buried into the toner particle, and/or the external additive becomes separated from the toner particle. In other words, the toner deterioration is exacerbated. Therefore, the abovementioned peripheral velocity ratio is set to a value within the range of 105%-120%. As the development roller 11, a roller, the arithmetic average roughness Ra (JIS B 0601-1994) of which measured with the use of a surface roughness tester SE-30II (product of Kosaka Laboratory Co., Ltd.) satisfied the following mathematical expression, in which Ra [μm] and X [μm] stand for the average roughness Ra of the development roller 11 and the volume average particle diameter of the developer, respectively, was used:

[Mathematical Expression 1]

$$0.33 \geqq A/X \geqq 0.20 \quad (1).$$

One of the methods for providing the development roller 11 with a preset degree of surface roughness is as follows. First, an elastic layer is formed on the peripheral surface of a metallic core. Then, the surface of the elastic layer is abraded. Then, a resin layer, which constitutes the surface layer of the development roller 11 is formed on the abraded peripheral surface of the elastic layer to a thickness of roughly 10 μm by roller coating, spray coating, dipping, or the like. Further, a desired degree of surface roughness may be achieved by dispersing particles of a proper size in a resin, as the material for the surface layer of the development roller 11, to form a surface layer which is uneven across the surface, instead of abrading the surface of the elastic layer. In this embodiment, a toner, which is 6 μm in volume average particle diameter, was used. Therefore, a roller, which was 1.2 μm-2.0 μm in average surface roughness Ra, was used as the development roller 11. As for the method for measuring the volume average particle diameter of the developer, a particle size distribution measuring apparatus LS-230 (product of Coulter Co., Ltd.), which is a laser-based apparatus of the diffraction type, was used in combination with a liquid module which was 0.04-200 μm in particle diameter measurement range, and the volume average particles diameter of the developer was calculated from the obtained volume-based particle size distribution. If the value of A/X in Mathematical Expression (1), given above, is no more than 0.20, toner cannot be efficiently conveyed, making it impossible to form an image, the solid black areas of which are satisfactory high in density. Further, the development roller 11 is low in surface roughness, being therefore less effective for scraping away the toner having adhered to the areas of the peripheral surface of the photosensitive drum 2, which correspond to the blank areas of an image, from the photosensitive drum 2. Therefore, the fog formation toner increases. On the other hand, if the value of A/X in Mathematical Expression (1) is no less than 0.33, toner can be more efficiently conveyed, increasing thereby the amount by which it is coated on the development roller 11. Therefore, the toner fails to be sufficiently charged by friction. Therefore, the amount of uncharged toner increases; in other words, the fog formation toner increases.

Below the development roller 11, a supply roller 13 having an elastic layer is located, which is rotatably supported in contact with the development roller 11. The supply roller 13 is rotationally driven in the same direction (indicated by arrow mark B) as the rotational direction of the development roller 11. The roles of the supply roller 13 are to supply the development roller 11 with toner, and to scrape away the toner remaining on the development roller 11 without being consumed for development. From the standpoint of supplying the development roller 11 with toner and scraping away the unconsumed toner on the development roller 11, the supply roller 13 is desired to be formed of sponge, or made up of a metallic core, and bristles of rayon, Nylon, or the like fiber, planted on the metallic core. At least, the surface layer of the supply roller 13 is desired to be formed of a foamed elastic substance, the pores of which are semi-independent. It is preferred that the surface layer of the supply roller 13 is formed of a foamed elastic substance, the pores of which are interconnected, because a supply roller formed of a foamed substance, the pores of which are interconnect in a manner of forming long holes, can hold a larger amount of toner, in its surface layer. In this embodiment, a roller formed of urethane sponge, the pores of which are interconnected, was used as the supply roller 13. As the foamed elastic substance for the supply roller 13, foamed rubber made by foaming silicon rubber, ethylene-propylene-diene rubber (EPDM), and the like, may be used. It is not mandatory that the pores of the supply roller 13 are interconnected; it is possible to use a foamed elastic substance, the pores of which are independent. As the width of the contact area between the supply roller 13 and development roller 11, 1-6 mm is effective. Further, it is desired that the peripheral surface of the supply roller 13 is provided with a certain amount of speed relative to the peripheral surface of the development roller 11, in the contact area between the two rollers 11 and 13. Referring to FIG. 2, the rotational direction f the supply roller 13 is desired to be such that the peripheral surface of the supply roller 13 moves in the opposite direction from the rotational direction of the development roller 11, in the contact area between the two rollers 11 and 13. In this embodiment, the contact width between the supply roller 13 and development roller 11 was set to 3 mm, and the amount of the linear pressure between the supply roller 13 and development roller 11 was 40 gf/cm (0.392 N/cm). Further, when developing the electrostatic latent image on the photosensitive drum 2, a voltage different from the development bias applied to the metallic core as the rotational axle of the supply roller 13 was applied. The elastic roller 13 used in this embodiment was roughly $10^8$ ohm in electrical resistance, and was roughly 15° in Asker CSC 2 hardness scale (Koobunshi Keiki Co., Ltd.). Incidentally, the development bias was applied to the development roller 11 by an electric power source 15. The recording apparatus is also provided with an electric power source 16 for applying, in coordination with a supply roller bias applying means, bias to the metallic core as the rotational axle of the supply roller 13, in the direction to transfer toner from the supply roller 13 to the development roller 11. In this embodiment, the bias applied to the supply roller 13 was set to −250 V relative to the development bias. That is, the voltage applied to the supply roller 13 was on the same side as the normal polarity to which toner is charged, relative to the potential level of the voltage applied to the development roller 11, and the difference in potential level between the supply roller 13 and development roller 11 is 250 V. The above described application of bias to the supply roller 13 facilitates the process of supplying the development roller 11 with toner, making it possible to obtain an image which is better in image density and smaller in the amount of the fog attributable to the residual toner on the photosensitive drum 2.

Attached above the development roller 11 is an elastic regulation blade 12 as a regulating member. The regulation blade 12 is formed of thin plate of metal, such as stainless steel or phosphor bronze, or resin, such as polyamide elastomer (PAE), which is stable in regulatory force and is capable of reliably charging toner to the negative polarity. The regulation blade 12 is attached to a metallic plate, being supported so that the area of the surface of the regulation blade 12, which is adjacent to the free edge of the blade 12, is placed in contact with the peripheral surface of the development roller 11. The contact pressure between the development roller 11 and regulation blade 12 is desired to be in a range of 10-45 g/cm in linear pressure. If the contact pressure is no more than 10 g/cm, it is impossible for toner to be properly charged. Therefore, the fog formation toner increases, causing the recording apparatus to form an image of low quality, that is, an image suffering from fogs. If the contact pressure exceeds 45 g/cm, the external additives in toner are likely to be separated from toner particles by excessive pressure. In other words, toner is likely to deteriorate, and reduce in chargeability. The method for measuring the amount of linear contact pressure between the development roller 11 and blade 12 is as follows. That is, a piece of thin plate of stainless steel, which is 100 mm in length, 15 mm in width, and 30 μm in thickness, is prepared as a plate to be pulled out, and another piece of thin plate of stainless steel, which is 180 mm in length, 30 mm in width, and 30 μm in thickness, is prepared as a pinching plate, which is folded in half in terms of the lengthwise direction. Then, the plate to be pulled out is inserted between the two halves of the pinching plate, and the pinching plate is inserted between the development roller 11 and regulation blade 12. Then, the plate to be pulled out is pulled out at a preset speed while keeping constant the amount of force applied to pull out the plate to be plate, with the use of a spring scale or the like, and reading the scale (unit of measurement: g). Then, the obtained value, or the amount of force necessary to pull out the plate to be pull out, is divided by 1.5 to convert it into the amount of the linear pressure measured in the unit of g/cm. In this embodiment, a piece of thin electrically conductive elastic plate, such as a piece of thin elastic metallic plate, is used as the regulation blade 12, although a blade made up of a piece of thin phosphor bronze plate, which is capable of providing a stable amount of pressure, and a sheet of polyamide elastomer (PAE) pasted on the surface of the phosphor bronze plate, may be employed. As for the contact direction of the regulation blade 12, it is the counter direction. That is, the regulation blade 12 is placed in contact with the development roller 11 so that the free edge of the regulation blade 12 is on the upstream side of the contact area between the two components 11 and 12, in terms of the rotational direction of the development roller 11. There is no specific requirement regarding the method for attaching the regulation blade 12 to the blade supporting plate. However, usually, the regulation blade 12 is tightly fastened to the blade supporting plate with small screws, or welded to the blade supporting plate. The surface roughness Ra of the regulation blade 12 used in this embodiment was roughly 1 μm. Also in this embodiment, the development roller 11 and regulation blade 12 were rendered the same in potential level; there was no difference in potential level between the development roller 11 and blade 12, as shown in FIG. 2. However, the development roller 11 and regulation blade 12 may be rendered different in potential level by applying blade bias to the regulation blade 12 formed of thin metallic plate such as thin plate of phosphor bronze, in order to provide a better condition for achieving a higher level of "solid black density", and also, for preventing the formation of an image suffering from fogs. "Solid black density" means the density of a solid image formed on recording medium when the development contrast, that is, the difference in potential level between the development bias applied to the development roller, and the surface potential level of the image formation area of the peripheral surface of the photosensitive drum is maximum.

That is, the image forming apparatus in this embodiment is an image forming apparatus in which the ratio of the peripheral velocity of the development roller 11 relative to that of the photosensitive drum 2 is 105%-120% (that is, 1.05 times-1.20 times), and the arithmetic average roughness Ra of the peripheral surface of the development roller 11 satisfies Mathematical Expression (1). Therefore, it is possible to control toner deterioration, by reducing the ratio of the peripheral velocity of the development roller 11 relative to that of the photosensitive drum 2, while achieving a satisfactory level of image density and forming a clean image, that is, a fog-free image.

The image forming apparatus 1 in this embodiment was subjected to a durability test in which the durability of the image forming apparatus was tested in terms of the number of copies outputted before image defects began to occur. The developing apparatus 4 with which the image forming apparatus 1 in this embodiment was provided was smaller in the amount of the mechanical toner damage attributable to the friction to which toner is subjected in the contact nip between the photosensitive drum 2 and development roller 11, being therefore advantageous in terms of toner deterioration control. More specifically, when the abovementioned peripheral velocity ratio was 120% the number of copies outputted by the image forming apparatus 1 in this embodiment before copies suffering from image defects, such as the nonuniformity in image density, fog, etc., attributable to the toner fusion to the regulation blade 12, and resultant streaky coating of the development roller 11 with toner began to be outputted was 1.5-2.0 times that by a developing apparatus in accordance with the prior art. In other words, controlling the developer deterioration made it possible to provide an apparatus, the life of which is substantially longer than that of an apparatus in accordance with the prior art, that is, an apparatus, which can be used for a longer period time than an apparatus in accordance with the prior art.

Embodiment 2

Figure 3:
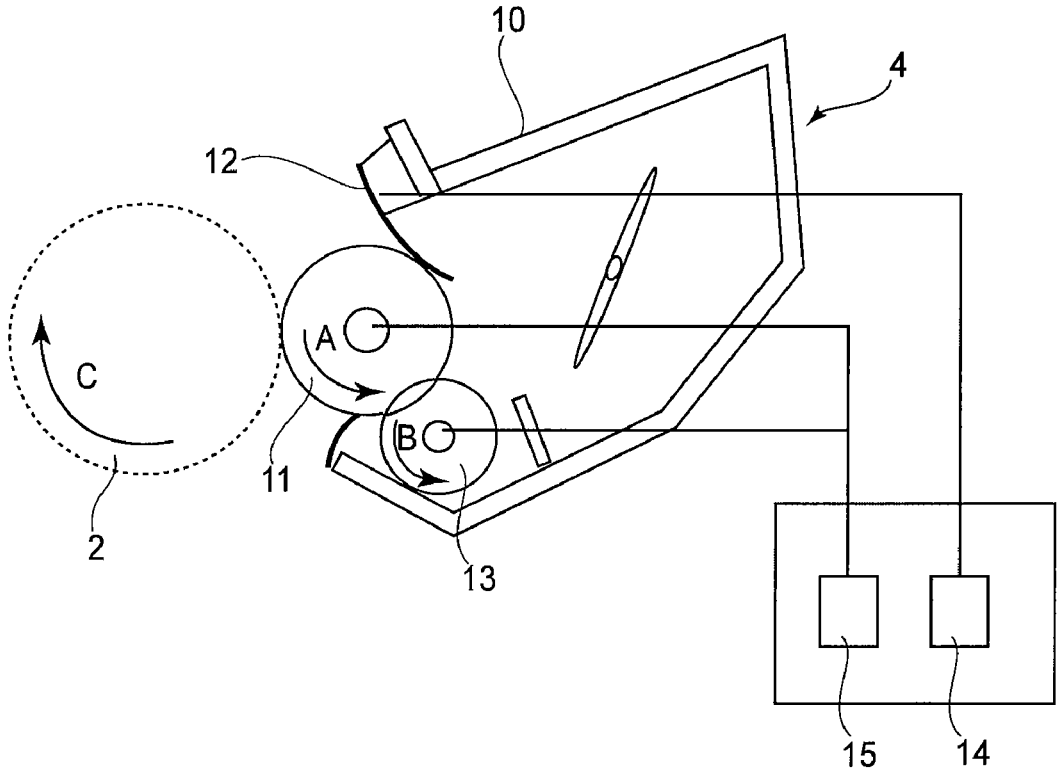
FIG. 3 is a schematic illustration of a developing device according to an embodiment of the present invention.

Next, referring to FIG. 3, the developing apparatus employed by an image forming apparatus, in another preferred embodiment of the present invention will be described. The basic structure and operation of the developing apparatus and image forming apparatus in this embodiment are roughly the same as those in the first preferred embodiment. Therefore, an element of the apparatuses in this embodiment, which is practically the same in function and structure as, or equivalent in function and structure to, the one in the first embodiment is given the same referential symbol as the one given to describe the first embodiment, and will not be described in detail. This embodiment is different from the first embodiment in that a roller, the arithmetic average roughness Ra (JIS B 0601-1994) of which satisfies the following mathematical expression, in which Ra [μm] and X [μm] stand for the average roughness Ra of the development roller 11 and the volume average particle diameter of the developer, was used as the development roller 11.

$$A/X<0.20 \quad (2).$$

As the regulation blade 12, a blade formed of thin plate of metal, such as thin plate of phosphor bronze, is used. To the regulation blade 12, −50 V--250 V of bias, relative to potential level of development roller 11, is applied from an electric power source 14 as a blade bias applying means. As the blade bias is applied to the regulation blade 12, with the peripheral velocity of the development roller 11 in this embodiment set to 240 mm/sec, 3 μA-7 μA of electric current flowed between the regulation blade 12 and development roller 11. The potential level of the regulation blade 12 is desired to be on the same side as the normal polarity to which toner is charged, relative to the potential level of the development roller 11. That is, in this embodiment, since the normal polarity to which toner is charged is negative, the potential level of the regulation blade 12 is on the negative side of the potential level of the development roller 11. Therefore, toner is more likely to adhere to the development roller 11 than to the regulation blade 12. Therefore, the thickness of the toner layer on the development roller 11 is kept at a proper value. As described above, it is desired that the potential level of the regulation blade 12 is on the negative side of that of the development roller 11, and also, that the difference in potential level between the regulation blade 12 and development roller 11 is no less than 50 V and no more than 250 V.

In this embodiment, therefore, when the normal polarity to which toner is charged is positive, the potential level of the regulation blade 12 is desired to be higher than that of the development roller 11 by no less than +50 V and no more than +250 V.

When the value of the average roughness Ra of the development roller 11 is small enough to satisfy Mathematical Expression (2), the development roller 11 is inferior in toner conveying ability compared to when the value of the average roughness Ra of the development roller 11 is otherwise. Thus, it is difficult to achieve a satisfactory level of "solid black density". Therefore, when the normal polarity to which toner is charged is negative, the potential level of the regulation blade 12 is desired to be lower than (on the negative side of) that of the development roller 11, in order to achieve a satisfactory level of "solid black density". With the employment of this arrangement, electric current such as the one described above flows between the regulation blade 12 and development roller 11, and therefore, the resultant electric field increases the amount (after toner on development roller 11 is regulated by regulation blade 12) by which toner is coated on the development roller 11. Further, the toner on the development roller 11 is kept pressed upon the development roller 11 by the force of the electric field. Therefore, the fog formation toner did not increase in spite of the increase in the amount of the toner coat on the development roller 11. Further, referring to FIG. 3, in this embodiment, while the electrostatic latent image on the photosensitive drum 2 was developed, the same voltage as the development voltage was applied by the electric power source 15 to the metallic core of the supply roller 13 which was kept in contact with the bottom side of the development roller 11.

That is, the image forming apparatus in this embodiment was an image forming apparatus in which the average roughness Ra of the development roller 11 satisfied the Mathematical Expression (2), and the ratio of the peripheral velocity of the development roller 11 relative to that of the photosensitive drum 2 was in the range of 105%-120%, yet, by applying −50 V--250 V of bias (relative to potential level of the development roller 11, provided that normal polarity to which toner is charged is negative) to the regulation blade 12 and reducing the ratio of the peripheral velocity of the development roller 11 relative to that of the photosensitive drum 2, it was possible to control toner deterioration while forming images which are clear, that is, free of fog, and satisfactory in image density.

The image forming apparatus 1 in this embodiment was also subjected to a durability test in which the durability of the image forming apparatus was tested in terms of the number of copies outputted before image defects began to occur. The developing apparatus 4 with which the image forming apparatus 1 in this embodiment is equipped was smaller in the amount of damage which it mechanically inflicted upon toner by rubbing the toner in the contact nip between the photosensitive drum 2 and development roller 11 when the apparatus was continuously used. In other words, the image forming apparatus 1 in this embodiment is advantageous from the standpoint of controlling toner deterioration. Further, it was smaller in the average roughness Ra of the development roller 11. Therefore, not only did it prevent the so-called filming, that is, the phenomenon that toner agglomerates in the recesses of the peripheral surface of the development roller 11 and lodges therein, but also, it prevented the friction between the development roller 11 and photosensitive drum 2 from becoming excessive. Therefore, the number of the copies outputted by the image forming apparatus 1 in this embodiment before copies suffering from image defects, such as nonuniformity in image density, fog, and the like, which were attributable to the fusing of toner to the regulation blade 12 and the resultant streaky coating of the development roller 11 with toner, began to be outputted was 1.8-2.5 times that outputted by the developing apparatus 20 structured in accordance with the prior art. In other words, this embodiment also was also able to provide, by controlling developer deterioration, an apparatus, the service life of which is substantially longer than an apparatus in accordance with the prior art, that is, an apparatus which can be used for a long period of time than an apparatus in accordance with the prior art.

Next, the effects of the preferred embodiments of the present invention will be described in the form of the comparison between the image forming apparatus 1 in the preferred embodiments of the present invention and those in the following comparative embodiments of the present invention, and those in the following experiments.

Comparative Embodiment 1

Figure 8:
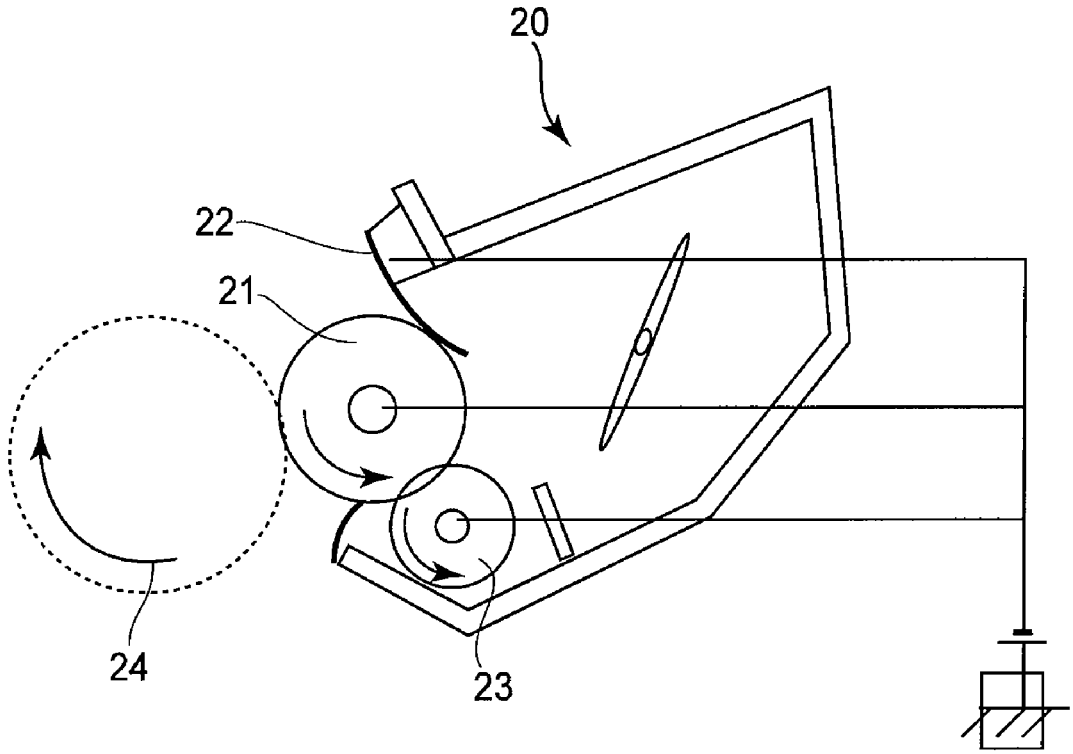
FIG. 8 is a schematic illustration of an example of a conventional developing device.

In the case of the developing apparatus in this embodiment, the ratio of the peripheral velocity of the development roller 11 relative to that of the photosensitive drum 2 was set to 130%, as it was in the developing apparatus (shown in FIG. 8) in accordance with the prior art. Further, the toner was 6 μm in volume average particle diameter, and the development roller 21 was 1.0 μm in average roughness Ra. The amount of apparent mutual invasion between the development roller 21 and photosensitive drum 24 was 40 μm. No difference in potential was provided between the development roller 21 and a regulation blade 22. This developing apparatus was mounted in an image forming apparatus, and was subjected to a duration test, in which 5,000 copies were printed to evaluate the apparatus for image quality. The test was conducted at the normal temperature and humidity (25° and 60% RH). The result was: Toner was deteriorated by the frictional force between the development roller 21 and photosensitive drum 24, causing the apparatus to form images suffering from defects, such as the so-called "ghost", developmental steaks, etc. "Ghost" refers to the phenomenon that the remnants of the images formed during the preceding image forming processes appear in the following images.

Comparative Embodiment 2

In light of the result in the first comparative embodiment, in order to control the toner deterioration attributable to the frictional force between the development roller 11 and photosensitive drum 2, the resultant heat, etc., the ratio of the peripheral velocity of the development roller 11 relative to that of the photosensitive drum 2 was reduced compared to that in the first comparative embodiment.

As a result, it was proved that it was possible to control the toner deterioration attributable to the frictional force between the development roller 11 and photosensitive drum 2, the resultant heat, etc., by reducing the peripheral velocity ratio between the development roller 11 and photosensitive drum 2. More specifically, when the image forming apparatus employing the developing apparatus in this comparative embodiment was subjected to a printing test, in which 5,000 copies were printed, the image defects, such as the ghost, developmental streaks, etc., did not occur.

However, not only did the reduction in the peripheral velocity ratio between the development roller 11 and photosensitive drum 2 exacerbate the fog formation as shown in Table 1, but also, it prevented the apparatus from achieving a satisfactory level of "solid black density". This occurred because the reduction in the peripheral velocity ratio reduced the frictional force between the development roller 11 and photosensitive drum 2, and therefore, not only was the development roller 11 was reduced in its ability to scrape away the fog formation toner, but also, it failed to convey toner by an amount sufficient to achieve a satisfactory level of "solid black density". "Solid black density" is the highest level of image density, which can achieved when the difference between the potential level of an exposed point (light point) of an electrostatic latent image formed on a photosensitive drum, and the potential level of development bias.

Referring to Table 1, the amount of fog was measured with the use of a whiteness gauge TC-6DS (product of Tokyo Denshoku Co., Ltd.). As for the measurement of the amount of the fog formation toner on the photosensitive drum, the fog formation toner on the photosensitive drum was picked up by a piece of Mylar tape, and the whiteness of this piece of Mylar tape was compared with the whiteness of a blank piece of Mylar tape. Then, the difference in whiteness between these piece of tape was defined as the index for the amount of the fog formation toner on the photosensitive drum. When this index is no more than 0.7, the amount of the fog formation toner on the photosensitive drum is considered satisfactory, that is, insignificant. However, if the index is no less than 0.7, the effects of the fog formation toner are significant, in particular, when glossy paper is used as recording medium and/or when the image forming apparatus used for image formation is a color image forming apparatus, because the fog formation toner is generated by each of the Y, M, C, and Bk image forming stations. In other words, if the index is no less than 0.7, an image suffering from conspicuous fog will be formed. As to "solid black density", if it is no less than 1.3 in optical density, the solid black area of an image appeared uniform, and therefore, a "solid black density" level of no less than 1.3 was considered satisfactory. However, if the "solid black density" is no more than 1.3, the solid black area of an image appeared low in image density and/or nonuniform. Therefore, a "solid black density" level of no more than 1.3 was considered unsatisfactory. That is, as will be evident from the results given in Table 1, there was no peripheral velocity ratio range which was satisfactory in terms of both fog and "solid black density", in the case of the image forming apparatus in this comparative embodiment.

TABLE 1

| Peripheral velocity ratio (%) | Fog | Solid Black Density |
|---|---|---|
| 100 | 1.5 | 0.9 |
| 105 | 1.1 | 1 |
| 120 | 0.7 | 1.2 |
| 135 | 0.6 | 1.3 |

Comparative Embodiment 3

It is evident from the result in the second comparative embodiment that when there is no difference in peripheral velocity between the development roller 11 and photosensitive drum 2, that is, when the ratio of the peripheral velocity of the development roller 11 and photosensitive drum 2 is 100%, and therefore, there is no frictional force between the development roller 11 and photosensitive drum 2, the image forming apparatus is extremely unsatisfactory in terms of fog and "solid black density". In this comparative embodiment, therefore, it was thought to scrape away the fog formation toner on the development roller 11, by increasing the amount by which toner is coated on the development roller 11.

That is, in order to increase the amount by which toner is coated on the development roller 11, by improving the development roller 11 in the ability to convey toner, it was attempted to improve the development roller 11 in the ability to convey toner, by increasing the average roughness Ra of the development roller 11 (Table 2). However, as the amount of the toner coat on the development roller 11 increased, the toner particles located in the middle of the tone layer (in terms of radius direction of development roller 11) failed to satisfactorily contact the regulation blade 12, failing thereby to be satisfactorily charged by friction. As a result, uncharged toner and reversely charged toner increased; in other words, the fog formation toner increased. Therefore, it was attempted to use the force of an electric field to increase the amount by which toner is coated on the development roller 11. More specifically, −50 V to −250 V of blade bias, relative to the potential level of the development roller 11, was applied to the regulation blade 12 (Table 2). As a result, the toner on the development roller 11 was kept pressed toward the development roller 11 by the force of the electric field, which worked between the development roller 11 and regulation blade 12. Therefore, the toner layer on the development roller 11 increased in density, increasing thereby "solid black density".

TABLE 2

| Peripheral speed ratio = 100% | | | |
|---|---|---|---|
| Reg. Blade Bias (V) | Av. Roughness Ra | Fog on on Drum | Solid Bk density |
| no bias | 0.1 | 0.9 | 0.8 |
| | 0.8 | 1.5 | 0.9 |
| | 1.2 | 1.6 | 1.2 |
| | 1.8 | 1.7 | 1.2 |
| | 2.3 | 2.1 | 1.4 |
| | 3.5 | 2.5 | 1.5 |
| −200 | 0.1 | 1.2 | 1.4 |
| | 0.8 | 2 | 1.6 |
| | 1.2 | 2.1 | 1.6 |
| | 1.8 | 2.2 | 1.6 |
| | 2.3 | 2.7 | 1.6 |
| | 3.5 | 3.3 | 1.6 |

However, since the peripheral velocity ratio was 100%, there was no frictional force between the development roller 11 and photosensitive drum 2. Therefore, the microscopic ridges and valleys of the peripheral surface of the development roller 11 were ineffective to scrape away the toner on the photosensitive drum 2. Therefore, the toner having transferred onto the areas of the peripheral surface of the photosensitive drum 2, which correspond to the blank areas of an image, could not be recovered back onto the development roller 11. Thus, the amount by which toner was coated on the development roller 11 was increased by the application of bias or the like to the regulation blade 12. However, the fog formation toner increased along with the increase in the amount of the toner on the development roller 11.

[Experiment 1]

In light of the results in the first to third comparative embodiments, it was thought to scrape away the fog formation toner by setting the ratio of the peripheral velocity of the development drum 11 relative to that of the photosensitive drum 2 to 120% at which frictional force works between the development roller 11 and photosensitive drum 2, and increasing the amount by which toner is coated on the development roller 11 while being controlled by the regulation blade 12 in order to deal with the fog problem and to achieve a satisfactory level of "solid black density".

Figure 6:
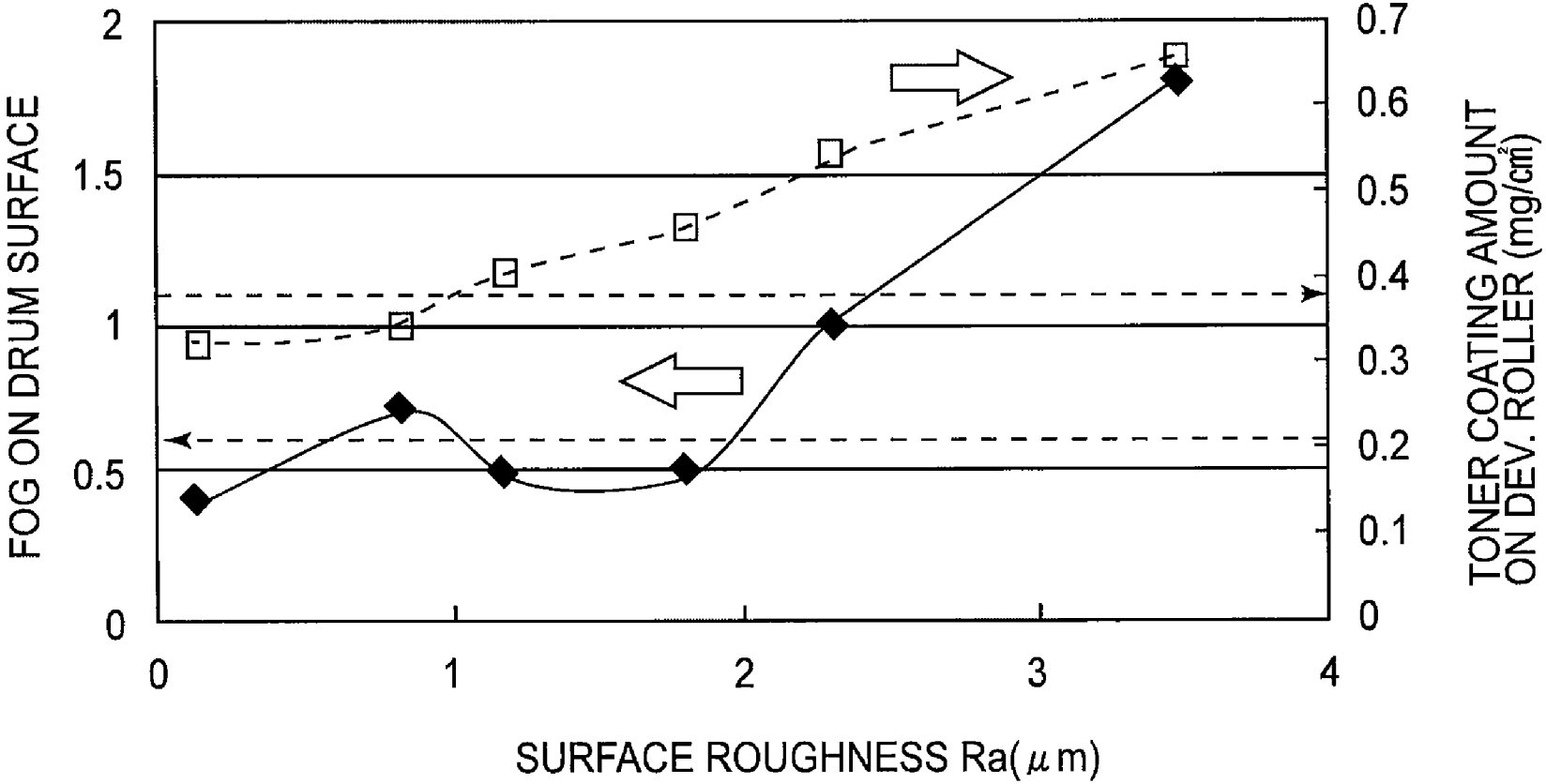
FIG. 6 shows properties of a production of fog and an amount of toner coating vs. the average surface roughness of the developing roller in an embodiment of the present invention.

In this experiment, the toner was 6 μm in volume average particle diameter, and the ratio of the peripheral velocity of the development roller 11 relative to that of the photosensitive drum 2 was 120%. FIG. 6 is a graph showing the relationships among the average roughness Ra of the development roller 11, which was varied in a range of 0.1 μm-3.5 μm, the amount of the fog generation toner on the photosensitive drum 2, and the amount of toner (mg/cm$^2$) on the development roller 11. In the case of the solid line, the vertical axis represents the amount (index) of the fog formation toner on the photosensitive drum 2, whereas in the case of the broken line, the vertical axis represents the amount of toner on the development roller 11. There was a correlation between the amount of toner on the development roller 11 and "solid black density". That is, when the peripheral velocity ratio was 120%, it was possible to achieve a satisfactory level of "solid black density", which is no less than 1.3, as long as the amount of toner on the development roller 11 was no less than roughly 0.38 (mg/cm$^2$).

The relationship between the surface roughness Ra and the amount by which toner was coated on the development roller 11 was linear; as the development roller 11 increased in the average roughness Ra, the amount by which toner was coated on the development roller 11 increased in proportion to the average roughness Ra. On the other hand, it was only within a certain range that the amount of the fog formation toner on the photosensitive drum 2 linearly increased in proportion to the increase in the amount of toner on the development roller 11. That is, the amount of the fog formation toner on the photosensitive drum 2 had two points of inflection: a point which corresponds to where the average roughness Ra of the development roller 11 was roughly 0.9 μm, and a point which corresponds to where the average roughness Ra of the development roller 11 was roughly 2.1 μm. More specifically, where the average roughness Ra of the development roller 11 was roughly between roughly 0.9 μm and 2.1 μm, as the average roughness Ra of the development roller 11 was increased from roughly 0.9 μm, the amount of the fog formation toner on the photosensitive drum 2 decreased, although the amount by which toner was coated on the development roller 11 increased. This occurred for the following reason. That is, where the average roughness Ra was in the range of 0.9 μm-2.1 μm, the difference in peripheral velocity between the photosensitive drum 2 and development roller 11 was effective to cause the microscopic ridges and valleys of the peripheral surface of the development roller 11 to scrape away the fog formation toner. Therefore, the toner having transferred from the development roller 11 onto the photosensitive drum 2 and adhered to the areas of the peripheral surface of the photosensitive drum 2, which corresponded to the blank areas of an image, was recovered back onto the development roller 11. If the average roughness Ra of the development roller 11 was below 1.2 μm, the development roller 11 (uneven peripheral surface of the development roller 11) was not effective to scrape away the fog formation toner, allowing the fog formation toner to increases. In addition, the development roller 11 was less effective to convey toner, and therefore, the development roller 11 was not coated with a sufficient amount of toner. On the other hand, where the average roughness Ra of the development roller 11 exceeded 2.0 μm, toner was coated on the development roller 11 by an amount too large for the toner particles in the mid (in terms of radius direction of development roller 11) portion of the toner layer to be sufficiently charged. Therefore, the fog formation toner increased. Moreover, where the average surface roughness Ra of the development roller 11 was excessively large, the microscopic ridges and valleys of the peripheral surface of the development roller 11 caused the formation of an image suffering from unwanted streaks. The following are evident from these results. That is, provided that toner is 6 μm in volume average particle diameter, the average surface roughness Ra of the development roller 11 is desired to be in the range of 1.2 μm-2.0 μm, because as long as it is in this range, the development roller 11 maintains its ability to efficiently convey toner, making it possible to achieve a "solid black density" of no less than 1.3, and to keep the fog formation toner index below 0.7. However, the average surface roughness range for the development roller 11, in which the development roller 11 maintains a sufficient amount of toner conveyance efficiency, and the amount of the fog formation toner remains under control, is not limited to the above described one. In other words, it shifts according to the volume average particle diameter of the toner used for image formation. In this experiment, a toner which was 6 μm in volume average particle diameter was used. However, all that is necessary is that the average surface roughness Ra of the development roller 11 satisfies the following mathematical expression, in which A [μm] and X [μm] stand for the average surface roughness Ra of the development roller 11 and volume average particle diameter of developer:

[Mathematical Expression 2]

$$0.33 \geqq A/X \geqq 0.2 \quad (1).$$

For example, in the case of a toner which is 5 μm in volume average particle diameter, the average surface roughness Ra of the development roller 11 was desired to be in a range of 1.0 μm-1.65 μm, whereas in the case of a toner which is 8 μm in volume average particles diameter, the average surface roughness Ra of the development roller 11 was desired to be in a range of 1.6 μm-2.6 μm. As long as the average surface roughness Ra of the development roller 11 was in the above-mentioned ranges, it was possible to scrape away the toner having transferred from the development roller 11 onto the photosensitive drum 2 and adhered to the areas of the photosensitive drum 2, which corresponded to the blank areas of an image. Table 3 shows the relationship between the "solid black density" and fog, in the test in which the average roughness Ra of the development roller 11 and the volume average particle diameter of developer were varied while the ratio of the peripheral velocity of the development roller 11 relative to that of the photosensitive drum 2 was kept at 120%. When the "solid black density" was no less than 1.3 in optical density, it was considered excellent (○), as it was in the second comparative embodiment. As for the amount (index) of the fog formation toner on the photosensitive drum 2, when it was no greater than 0.7, it was considered (○), also as it was in the second comparative embodiment. Further, Table 3 shows that when both the solid black density and amount of the fog formation toner on the photosensitive drum 2 were considered excellent (○), the Mathematical Expression (1) was satisfied.

TABLE 3

| Peripheral speed ratio 120% | | | | |
|---|---|---|---|---|
| Av. Roughness Ra(A) (μm) | Vol. Av. Particle size of Developer(μm) | A/X | Solid Black Density | Fog Prevent. |
| 0.9 | 5 | 0.18 | N | G |
| | 6 | 0.15 | N | G |
| | 8 | 0.11 | N | G |
| 1.2 | 5 | 0.24 | G | G |
| | 6 | 0.2 | G | G |
| | 8 | 0.15 | G | N |
| 1.6 | 5 | 0.32 | G | G |
| | 6 | 0.27 | G | G |
| | 8 | 0.2 | G | G |
| 2.0 | 5 | 0.4 | G | N |
| | 6 | 0.33 | G | G |
| | 8 | 0.25 | G | G |
| 3.0 | 5 | 0.6 | G | N |
| | 6 | 0.5 | G | N |
| | 8 | 0.38 | G | N |

If the average roughness R of the development roller 11 is less than 0.2 times the volume average particle diameter of toner, the development roller 11 is insufficient in the amount by which it conveys toner. On the other hand, if the average roughness R of the development roller 11 is greater than 0.33 times the volume average particle diameter of toner, the development roller 11 is excessive in the amount by which it conveys toner, contributing to the increase in the amount of the fog formation toner. Further, regarding the relationship between the volume average particle diameter of developer and the average roughness Ra of the development roller 11, the latter must be large enough to satisfy the Mathematical Expression (1). Otherwise, the development roller 11 cannot satisfactorily scrape away the toner having adhered to the areas of the peripheral surface of the photosensitive drum 2, which correspond to the blank areas of an image, to recover it. However, if the average roughness Ra of the development roller 11 is excessively large relative to the volume average particle diameter of toner, the ridges and valleys of the peripheral surface of the development roller 11 do not match in size the particle diameter of toner, although the toner can be conveyed by an ample amount. Therefore, it is impossible to satisfactorily scrape away the toner having adhered to the areas of the photosensitive drum 2, which correspond to the blank areas of an image, to recover it.

[Experiment 2]

Figure 7:
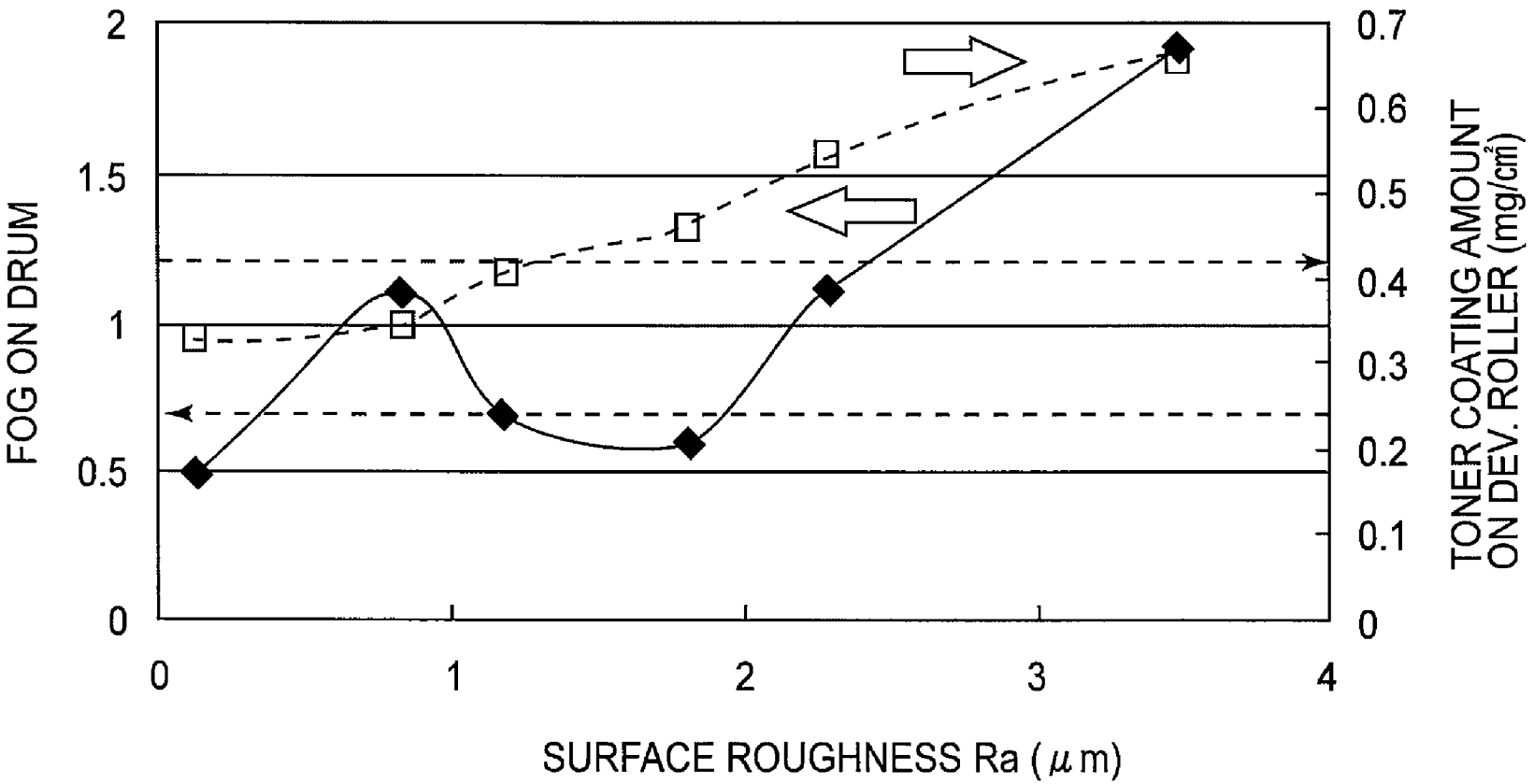
FIG. 7 shows properties of a production of fog and an amount of toner coating vs. the average surface roughness of the developing roller in an embodiment of the present invention.

In the second experiment, the peripheral velocity ratio was set to 105% to ensure that the frictional force worked between the development roller 11 and photosensitive drum 2. Further, the amount (index) of the fog formation toner on the photosensitive drum 2 and the amount (mg/cm$^2$) by which toner was coated on the development roller 11 were measured while varying the average roughness Ra of the development roller 11 in a range of 0.1 μm-3.5 μm. The results of the examination of this experiment are given in FIG. 7, in which in the case of the solid line, the vertical axis represents the amount (index) of the fog formation toner on the photosensitive drum 2, whereas in the case of a broken line, the vertical axis represents the amount of the toner on the development roller 11. There was a correlation between the amount of the toner on the development roller 11 and "solid black density". When the peripheral velocity ratio was 105%, as long as the amount of the toner on the development roller 11 was roughly 0.43 (mg/cm$^2$), it was possible to achieve a satisfactorily high level of solid black density, that is, a level of no less than 1.3.

If the amount of the fog formation toner on the photosensitive drum 2 is no more than 0.7, and "solid black density" is no less than 1.3, an excellent image is obtained. Thus, in this experiment, in which the toner was 6 μm in volume average particle diameter and the peripheral velocity ratio was 105% as in the first experiment, as long as the average roughness Ra of the development roller 11 was in a range of 1.2 μm-2.0 μm, the development roller 11 was coated with a satisfactory amount of toner, and the ridges and valleys of the peripheral surface of the development roller 11 were effective as a scraping means. Therefore, the fog formation toner remained under control. In this experiment, a toner which was 6 μm in volume average particle diameter was used. However, as long as the relationship between the average roughness Ra of the development roller 11 and volume average particle diameter of the developer satisfied the following Mathematical Expression (3), in which A [μm] and X [μm] stand for the average surface roughness Ra of the development roller 11 and volume average particle diameter of developer, respectively:

[Mathematical Expression 3]

$$0.33 \geqq A/X \geqq 0.2 \quad (1),$$

the resultant images were satisfactory in terms of both "solid black density" and fog, as shown in Table 3 which shows the results of the first experiment, even when the peripheral velocity ratio was 105%.

[Experiment 3]

As will be evident from the first and second experiments, when a toner was 6 μm in volume average particle diameter, unless the relationship between the average roughness Ra of the development roller 11 and volume average particle diameter of the developer satisfied the following Mathematical Expression (3), in which A [μm] and X [μm] stand for the average surface roughness Ra of the development roller 11 and volume average particle diameter of developer, respectively:

[Mathematical Expression 4]

$$0.33 \geqq A/X \geqq 0.2 \quad (1),$$

the problem that the fog formation toner increases, the problem that "solid black density" lowers, and/or the like occurred.

In this experiment, therefore, development rollers, which satisfied: A/X<0.2 were tested. More specifically, the peripheral velocity ratio was set to 105%, and a toner which was 6 μm in volume average particle diameter was used for image formation. Further, the average roughness Ra of the development roller 11 was 0.1 μm (A/X=0.02), and blade bias was applied to the regulation blade 12. The values of the "solid black density" and the amount (index) of the fog formation toner on the photosensitive drum 2, which were obtained while varying the regulation blade bias, are given in Table 4. In this experiment, the normal polarity to which the toner was charged was negative.

TABLE 4

| Reg. Blade Bias (V) | Fog on drum | Solid Black Density |
|---|---|---|
| no bias | 0.7 | 0.9 |
| −50 | 0.7 | 1.3 |
| −100 | 0.5 | 1.5 |
| −150 | 0.3 | 1.5 |
| −200 | 0.3 | 1.5 |
| −250 | 0.3 | 1.5 |

As will be evident from Table 4, as −50 V-−250 V (relative to potential level of development roller 11) of bias was applied to the regulation blade 12. As a result, 3 μA-7 μA of electric current flowed between the regulation blade 12 and development roller 11 (peripheral velocity of the development roller 11 was 240 mm/sec). Thus, the toner was pressed upon the development roller 11 by the force of the electric field, being thereby compacted to the highest density. In other words, toner was coated on the development roller 11 by a greater amount. Further, the electric field effected to press the toner toward the development roller 11. Therefore, the fog formation toner decreased in spite of the increase in the amount of the toner on the development roller 11. In other words, the application of the regulation blade bias made it possible to reduce the fog formation toner while raising the "solid black density". The application of a regulation blade bias which was higher than −250 V (relative to potential level of development roller 11) did not result in the further improvement in the "solid black density", neither the reduction in the amount of the fog formation toner. On the contrary, the toner deterioration, such as the separation of external additives from toner particles, occurred because of the electrical reason. Further, a regulation blade bias which was less than −50 V (relative to potential level of development roller 11) was not effective for the improvement in the "solid black density" and the reduction in the amount of the fog formation toner. That is, even when a roller, which satisfied: A/X<0.2, was used as the development roller 11, the application of −50 V-−250 V (relative to potential level of development roller 11) of bias to regulation blade 12 made it possible to raise image density while controlling the fog formation toner. In other words, this experiment revealed that the potential level of the regulation blade 12 is desired to be on the same side as the normal polarity to which toner is charged, and also, that the difference in potential level between the regulation blade 12 and development roller 11 is in the range of 50 V-250 V.

The experiment also revealed that the reduction in the average roughness Ra of the development roller 11 can prevent toner from collecting, and firmly lodging, in the minuscule valley portions of the peripheral surface of the development roller 11, and also, it can prevent frictional force from being generated by an excessive amount between the development roller 11 and photosensitive drum 2.

[Experiment 4]

In the fourth experiment, the peripheral velocity ratio was set to 120% to ensure that there was a sufficient amount of frictional force between the development roller 11 and photosensitive drum 2. Otherwise, the fourth experiment is the same as the third experiment, in which a toner which was 6 μm in volume average particle diameter was used, and a development roller, the surface roughness Ra of which was 0.1 μm (A/X=0.02), was used as the development roller 11. To the regulation blade 12, blade bias was applied. The values of the "solid black density" and the amount (index) of the fog formation toner on the photosensitive drum 2, which were obtained using various regulation blade biases, are given in Table 5.

TABLE 5

| Reg. Blade Bias (V) | Fog on drum | Solid Black Density |
|---|---|---|
| no bias | 0.4 | 0.9 |
| −50 | 0.4 | 1.4 |
| −100 | 0.3 | 1.5 |
| −150 | 0.3 | 1.5 |

TABLE 5-continued

| Reg. Blade Bias (V) | Fog on drum | Solid Black Density |
|---|---|---|
| −200 | 0.1 | 1.5 |
| −250 | 0.1 | 1.6 |

Also in this experiment in which the peripheral velocity ratio was 120% and the development roller 11 satisfied: A/X<0.2, keeping the regulation blade bias in the range of −50 V--250 V (relative to potential level of development roller 11) made it possible to keep the amount of the fog formation toner on the photosensitive drum 2 at a level no higher than 0.7, and "solid black density" at no less than 1.3; it made it possible to obtain excellent images.

To summarize the third and fourth experiments, it is desired that the peripheral velocity of the development roller is 1.05-1.20 times that of the photosensitive drum; A/X<0.2; the potential level of the regulation blade is on the same side (with reference to potential level of development roller) as the normal polarity to which toner is charged, and the difference in potential level between the development roller and regulation blade is within the range of 50 V-250 V. That is, satisfying the abovementioned conditions makes it possible to improve the image forming apparatus in terms of the fog formation toner on the photosensitive drum, and "solid black density".

Embodiment 3

Figure 4:
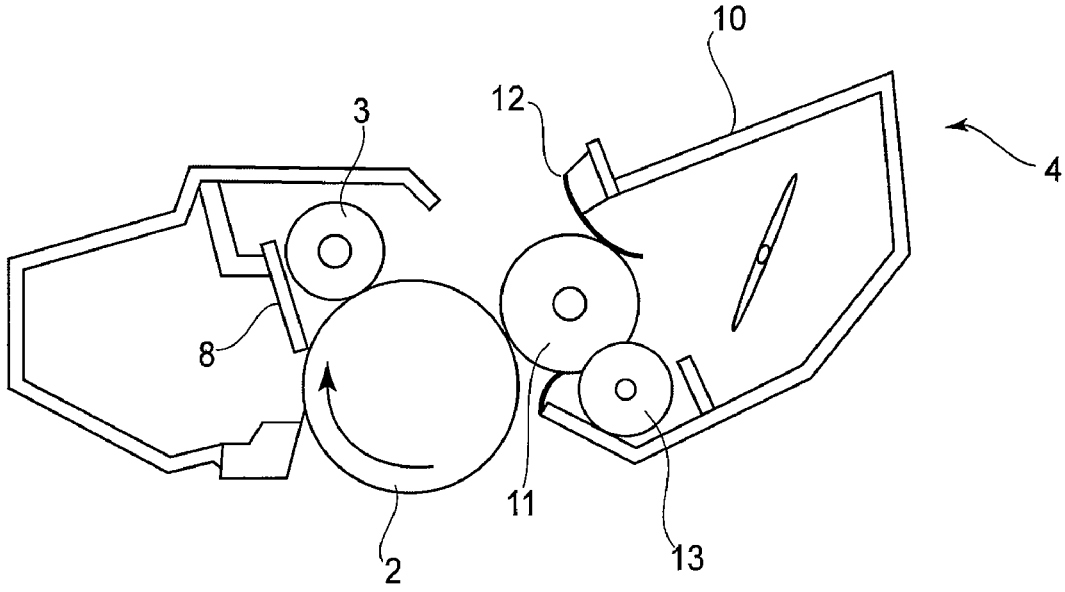
FIG. 4 is a schematic illustration of a process cartridge according to an embodiment of the present invention.

FIG. 4 is a schematic sectional view of an example of a process cartridge 30 which is removably mountable in an image forming apparatus in accordance with the present invention.

The process cartridge 30 has the development roller 11 as a developer bearing member, the regulation blade 12 as a developer regulating member, the supply roller 13, etc. The regulation blade 12 is positioned so that one of its primary surfaces makes contact with the peripheral surface of the development roller 11. The developing apparatus 4 in this embodiment is the same in structure as that in the first embodiment. The process cartridge 30 comprises the developing apparatus 4, photosensitive drum 2, charging means 3, and cleaning blade 8 as a cleaning means, which are integrally disposed in a plastic supporting member, a part of which constitutes a waste toner storage.

In other words, the process cartridge 30 in this embodiment is an integration of the abovementioned developing apparatus 4 and a unit for processing the photosensitive drum 2. Some process cartridges are not provided with the cleaning means and charging means.

Therefore, any of the developing apparatuses 4 in the preceding embodiments is employable as one of the structural components of the process cartridge 30. The process cartridge 30 is removably mountable in an image forming apparatus. Thus, the entirety of the image forming means of an image forming apparatus can be simply replaced by replacing the process cartridge 30. Therefore, the employment of the process cartridge 30 improves an image forming apparatus in terms of ease of maintenance.

Figure 5:
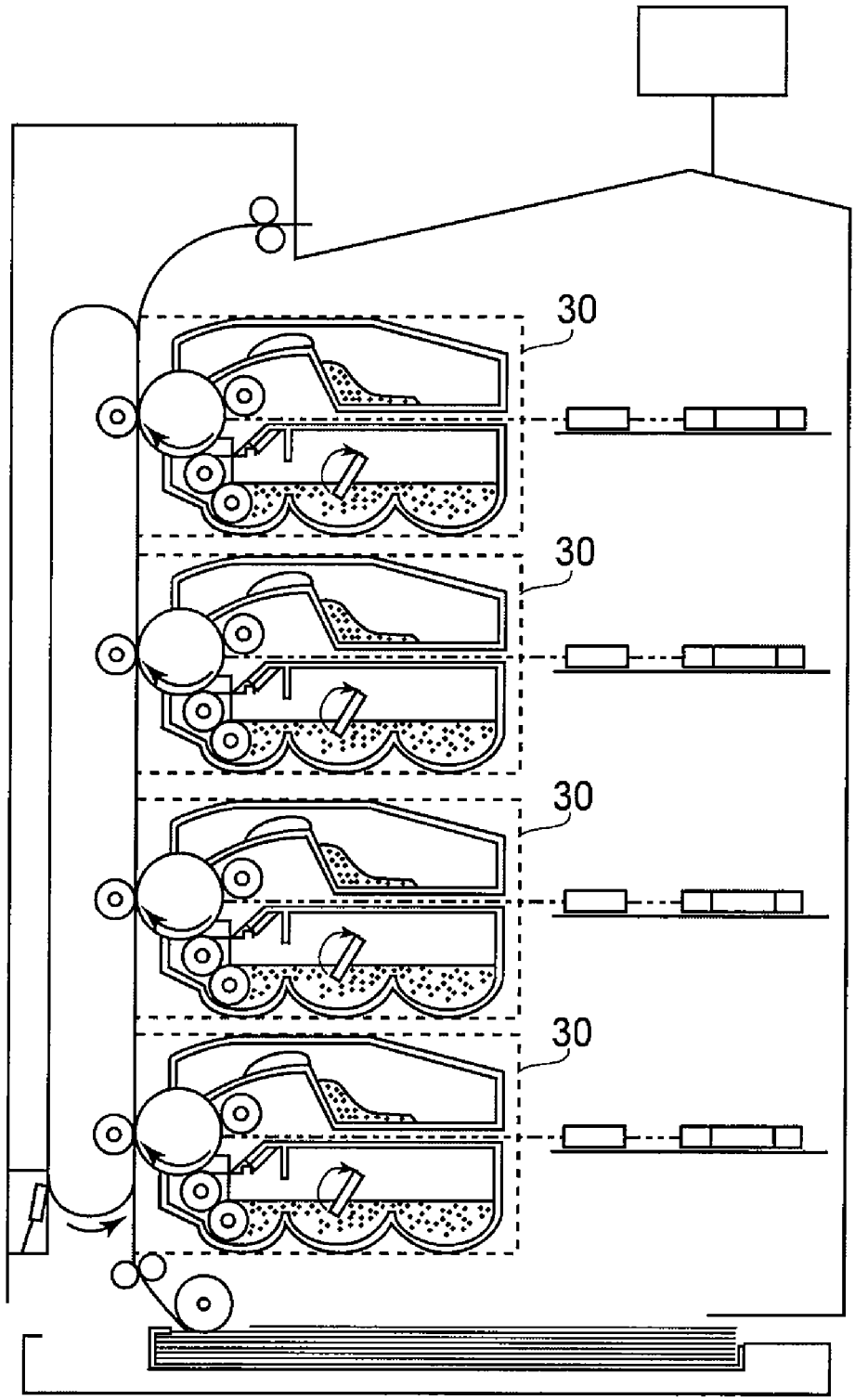
FIG. 5 is a schematic illustration of an image forming apparatus according to an embodiment of the present invention.

FIG. 5 is a schematic view of a color image is forming apparatus which employs four process cartridges 30: Y, M, C, and K process cartridges. The developing apparatuses in this embodiment are no more than 0.7 in the amount (index) of the fog formation toner on the photosensitive drum. Therefore, this color image forming apparatus can form images, the fogs of which are inconspicuous, even though it develops four monochromatic color images per full-color image. Therefore, when the color image forming apparatus is used, the damage to developer, which is attributable to the friction which occurs in the contact area between a developer bearing member and an image bearing member, can be controlled while making a color image forming apparatus output clear images, that is, images which are satisfactory in image density and free of fog.

Black color is higher in the frequency of usage than the other colors, and the human eye can detect the presence of black fog more easily than it can detect the fog of the other colors. Therefore, it is desired that the ratio of the peripheral velocity of the development roller 11 of each of the color (Y, M, and C) developing apparatuses 4 relative to that of the corresponding photosensitive drum 2 is set to 105%, whereas the ratio of the peripheral velocity of the development roller 11 of the black developing apparatus 4 relative to that of the corresponding photosensitive drum 2 is set to 120%. In other words, it is desired so that the peripheral velocity ratio for each color developing apparatus 4 is set to be lower than that for the colorless developing apparatus 4. With the employment of this setup, the fog formation can be controlled without reducing a color image forming apparatus in black text quality, and also, it is possible to output color images which are more durable than the color images outputted by a color image forming apparatus in accordance with the prior art.

Incidentally, in the preceding preferred embodiments, the development roller 11 was always kept in contact with the photosensitive drum 2. However, the development roller 11 may be kept separated from the photosensitive drum 2 except during development.

Further, as the means for providing a preset peripheral velocity ratio between the photosensitive drum 2 and development roller 11, the relationship, in terms of diameter, between the gear with which the photosensitive drum 2 is provided, and the gear with which the development roller 11 is provided, may be adjusted.

According to the present invention, the image defects attributable to developer deterioration can be controlled. As one of the practical effects of the present invention, it is possible to list the effect that the present invention can control the damage sustained by developer in the contact nip between a developer bearing member and an image bearing member, while outputting clear images, that is, images which are satisfactory in image density and free of fog, making it thereby possible to provide an apparatus which can be used for a long period of time, that is, an apparatus which is longer in service life than an apparatus in accordance with the prior art.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications No. 318549/2005 filed Nov. 1, 2005 and No. 292711/2006 filed Oct. 27, 2006 which are hereby incorporated by reference.

What is claimed is:

1. An image forming apparatus comprising:

a first image bearing member;

a first developer carrying member, contactable to said first image bearing member, that carries a black developer to a first developing position to develop a first electrostatic image formed on said first image bearing member with the black developer;

a first developer regulating member, contacted to the surface of said first developer carrying member, that regulates an amount of the black developer carried on said first developer carrying member;

a second image bearing member;

a second developer carrying member, contactable to said second image bearing member, that carries a chromatic developer to a second developing position to develop a second electrostatic image formed on said second image bearing member with the chromatic developer; and a second developer regulating member, contacted to the surface of said second developer carrying member, that regulates an amount of the chromatic developer carried on said second developer carrying member, wherein a peripheral speed of said first developer carrying member is not less than 1.05 times and not more than 1.20 times a peripheral speed of said first image bearing member, and a peripheral speed of said second developer carrying member is not less than 1.05 times and not more than 1.20 times a peripheral speed of said second image bearing member, wherein an arithmetic average roughness Ra of a surface of said first developer carrying member is less than 0.20 times a volume average particle size of the black developer, and an arithmetic average roughness Ra of a surface of said second developer carrying member is less than 0.20 times a volume average particle size of the chromatic developer, wherein a potential of said first developer regulating member is different from a potential of said first developer carrying member toward a larger potential of a regular charge polarity of the black developer, and a potential of said second developer regulating member is different from a potential of said second developer carrying member toward a larger potential of a regular charge polarity of the chromatic developer, wherein a potential difference between the potential of said first developer regulating member and the potential of said first developer carrying member is not less than 50V and not more than 250V, and a potential difference between the potential of said second developer regulating member and the potential of said second developer carrying member is not less than 50V and not more than 250V, and wherein a ratio of the peripheral speed of said second developer carrying member to the peripheral speed of said second image bearing member is smaller than a ratio of the peripheral speed of said first developer carrying member to the peripheral speed of said first image bearing member.

2. The apparatus according to claim 1, wherein a depth of impression of said first developer carrying member into said first image bearing member is not less than 10 μm and not more than 50 μm.

3. The apparatus according to claim 1, wherein toner particles contained in the black developer have a shape factor SF-1 of not less than 100 and not more than 160 and have a shape factor SF-2 not less than 100 and not more than 140.

* * * * *